US008991655B2

(12) United States Patent
Pelkey

(10) Patent No.: US 8,991,655 B2
(45) Date of Patent: Mar. 31, 2015

(54) FLUID DISPENSERS WITH INCREASED MECHANICAL ADVANTAGE

(71) Applicant: Ecolab USA Inc., St. Paul, MN (US)

(72) Inventor: John T. Pelkey, St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 26 days.

(21) Appl. No.: 13/768,110

(22) Filed: Feb. 15, 2013

(65) Prior Publication Data

US 2014/0231459 A1 Aug. 21, 2014

(51) Int. Cl.
*B67D 7/06* (2010.01)
*A47K 5/12* (2006.01)

(52) U.S. Cl.
CPC ..... *A47K 5/1211* (2013.01)
USPC ..... 222/181.1; 222/181.3

(58) Field of Classification Search
USPC ..... 222/180, 181.1, 181.2, 181.3, 321.8, 222/309, 477, 505
See application file for complete search history.

(56) References Cited

U.S. PATENT DOCUMENTS

| | | | | |
|---|---|---|---|---|
| 2,898,009 | A * | 8/1959 | Green | 222/308 |
| 3,458,090 | A | 7/1969 | Scoggin, Jr. | |
| 4,036,406 | A * | 7/1977 | Jespersen et al. | 222/181.2 |
| 4,084,729 | A | 4/1978 | Epple | |
| 4,673,109 | A * | 6/1987 | Cassia | 222/153.03 |
| 4,921,150 | A | 5/1990 | Lagergren et al. | |
| 5,033,657 | A | 7/1991 | Whittington | |
| 5,156,293 | A | 10/1992 | Petterson et al. | |
| 5,373,970 | A | 12/1994 | Ophardt | |
| 5,431,309 | A * | 7/1995 | Ophardt | 222/181.3 |
| 5,445,288 | A | 8/1995 | Banks | |
| 5,465,877 | A | 11/1995 | Bell et al. | |
| 5,492,247 | A | 2/1996 | Shu et al. | |
| 5,836,482 | A | 11/1998 | Ophardt et al. | |
| 5,992,698 | A | 11/1999 | Copeland et al. | |
| 6,036,056 | A | 3/2000 | Lee et al. | |
| 6,082,586 | A | 7/2000 | Banks | |
| 6,189,740 | B1 | 2/2001 | Wade et al. | |
| 6,209,752 | B1 | 4/2001 | Mitchell et al. | |

(Continued)

FOREIGN PATENT DOCUMENTS

| | | |
|---|---|---|
| EP | 0176135 A2 | 4/1986 |
| EP | 1454576 A2 | 9/2004 |

(Continued)

OTHER PUBLICATIONS

U.S. Appl. No. 13/869,205, by John T. Pelkey, filed Apr. 24, 2013.

(Continued)

*Primary Examiner* — Patrick M Buechner
(74) *Attorney, Agent, or Firm* — Shumaker & Sieffert, P.A.

(57) ABSTRACT

A fluid dispenser includes a dispense mechanism that provides for increased mechanical advantage. The dispense mechanism includes a lever member and an actuator. The lever member includes a first lever section that receives application of an input force and a second lever section that applies an output force to the actuator. The lever member and/or the actuator are configured to provide at least two contact points between the actuator and the second lever section during the course of a dispensing stroke such that the mechanical advantage provided at a first one of the at least two contact points is greater than the mechanical advantage provided at a second one of the at least two contact points.

10 Claims, 7 Drawing Sheets

(56) References Cited

U.S. PATENT DOCUMENTS

| | | | | |
|---|---|---|---|---|
| 6,347,724 | B1 | 2/2002 | Chen et al. | |
| 6,516,976 | B2 * | 2/2003 | Lewis et al. | 222/321.8 |
| 6,607,103 | B2 | 8/2003 | Gerenraich et al. | |
| 6,619,512 | B1 | 9/2003 | Sayers et al. | |
| 6,701,573 | B1 | 3/2004 | Ciavarella et al. | |
| 6,707,873 | B2 | 3/2004 | Thompson | |
| 6,772,328 | B1 | 8/2004 | Talbot et al. | |
| 6,877,642 | B1 | 4/2005 | Maddox et al. | |
| 7,044,328 | B1 | 5/2006 | Ciavarella | |
| 7,066,356 | B2 | 6/2006 | Schuman et al. | |
| 7,084,592 | B2 | 8/2006 | Rodrian | |
| 7,232,045 | B2 | 6/2007 | Ophardt et al. | |
| 7,247,140 | B2 | 7/2007 | Ophardt | |
| 7,278,554 | B2 | 10/2007 | Armstrong | |
| 7,296,765 | B2 | 11/2007 | Rodrian | |
| 7,367,477 | B2 | 5/2008 | Ophardt et al. | |
| 7,530,477 | B2 | 5/2009 | Ophardt | |
| 7,540,397 | B2 | 6/2009 | Muderlak et al. | |
| 7,568,598 | B2 | 8/2009 | Ophardt et al. | |
| 7,611,030 | B2 | 11/2009 | Reynolds et al. | |
| 7,637,391 | B2 | 12/2009 | Rosenkranz et al. | |
| 7,748,574 | B2 | 7/2010 | Ophardt et al. | |
| 7,765,916 | B2 | 8/2010 | Ophardt et al. | |
| 7,798,370 | B2 | 9/2010 | Ciavarella et al. | |
| 7,798,371 | B2 | 9/2010 | Ophardt | |
| 7,896,196 | B2 | 3/2011 | Wegelin et al. | |
| 7,909,209 | B2 | 3/2011 | Reynolds et al. | |
| 7,992,804 | B2 | 8/2011 | Nauels | |
| 8,245,881 | B2 | 8/2012 | Ophardt | |
| 2002/0074356 | A1 * | 6/2002 | Lewis et al. | 222/181.3 |
| 2003/0141318 | A1 | 7/2003 | Sorensen et al. | |
| 2004/0232168 | A1 | 11/2004 | Ciavarella et al. | |
| 2005/0064281 | A1 | 3/2005 | Ophardt | |
| 2005/0072808 | A1 | 4/2005 | Kitamura | |
| 2005/0263545 | A1 | 12/2005 | Ophardt | |
| 2005/0284888 | A1 | 12/2005 | Rhodenbaugh et al. | |
| 2006/0032871 | A1 | 2/2006 | Ophardt et al. | |
| 2006/0041197 | A1 | 2/2006 | Ophardt | |
| 2006/0175353 | A1 | 8/2006 | Ophardt et al. | |
| 2006/0213929 | A1 | 9/2006 | Ophardt et al. | |
| 2007/0000941 | A1 | 1/2007 | Hadden et al. | |
| 2007/0158359 | A1 | 7/2007 | Rodrian | |
| 2007/0169576 | A1 | 7/2007 | Ophardt et al. | |
| 2007/0257058 | A1 | 11/2007 | Ophardt et al. | |
| 2008/0121659 | A1 | 5/2008 | Ophardt | |
| 2008/0185399 | A1 | 8/2008 | Yang et al. | |
| 2008/0283556 | A1 | 11/2008 | Snodgrass et al. | |
| 2009/0045221 | A1 | 2/2009 | Ophardt et al. | |
| 2009/0101671 | A1 | 4/2009 | Cittadino et al. | |
| 2009/0120950 | A1 | 5/2009 | Titas et al. | |
| 2009/0184137 | A1 | 7/2009 | O'Brien | |
| 2009/0204256 | A1 | 8/2009 | Wegelin | |
| 2009/0266842 | A1 | 10/2009 | Snodgrass | |
| 2009/0302061 | A1 | 12/2009 | Ophardt | |
| 2009/0302067 | A1 | 12/2009 | Hendrickx et al. | |
| 2009/0308887 | A1 | 12/2009 | Woo et al. | |
| 2010/0012679 | A1 | 1/2010 | Brownlee | |
| 2010/0059550 | A1 | 3/2010 | Ciavarella et al. | |
| 2010/0072227 | A1 | 3/2010 | Cittadino et al. | |
| 2010/0140297 | A1 | 6/2010 | Ophardt et al. | |
| 2010/0147890 | A1 | 6/2010 | Ciavarella | |
| 2010/0163580 | A1 | 7/2010 | Ophardt et al. | |
| 2010/0206909 | A1 | 8/2010 | O'Brien | |
| 2010/0237096 | A1 | 9/2010 | Wegelin | |
| 2010/0252568 | A1 | 10/2010 | Ciavarella et al. | |
| 2010/0288788 | A1 | 11/2010 | Ophardt | |
| 2010/0308076 | A1 | 12/2010 | Snodgrass | |
| 2010/0320227 | A1 | 12/2010 | Reynolds | |
| 2011/0011890 | A1 | 1/2011 | Rosenkranz et al. | |
| 2011/0017778 | A1 | 1/2011 | Kadiks et al. | |
| 2011/0056987 | A1 | 3/2011 | Proper et al. | |
| 2011/0062182 | A1 | 3/2011 | Reynolds | |
| 2011/0101032 | A1 | 5/2011 | Hsu | |

FOREIGN PATENT DOCUMENTS

| | | | |
|---|---|---|---|
| EP | 1280448 | B1 | 2/2008 |
| EP | 20055871 | A2 | 12/2008 |
| EP | 2223642 | A2 | 9/2010 |
| JP | 2000023871 | A | 1/2000 |
| WO | 9420407 | A1 | 9/1994 |
| WO | 0249490 | A1 | 6/2002 |
| WO | 2004876731 | A2 | 10/2004 |
| WO | 2008006209 | A2 | 1/2008 |
| WO | 2011077111 | A1 | 6/2011 |

OTHER PUBLICATIONS

U.S. Appl. No. 13/769,155, by John T. Pelkey, filed Feb. 15, 2013.
U.S. Appl. No. 13/868,645, by John T. Pelkey, filed Apr. 23, 2013.
International Search Report and Written Opinion of counterpart international application No. PCT/US2014/015498, dated Jun. 13, 2014, 12 pp.

* cited by examiner

FLUID DISPENSERS WITH INCREASED MECHANICAL ADVANTAGE

TECHNICAL FIELD

The disclosure relates to fluid dispensers.

BACKGROUND

Hand washing is important in many industries, including hospitality (hotels, restaurants, etc.) and healthcare (hospitals, nursing homes, etc.). In addition, there are many other applications in which the dispensing of various fluids occurs. To facilitate hand washing, for example, fluid dispensers that dispense hand cleansing products may be placed near sinks of a kitchen, washroom, or other location. Such fluid dispensers house a disposable or refillable product container, such as a cartridge or flexible bag, containing a supply of the fluid product to be dispensed. The fluid may include, for example, foams, liquids, and/or gels. The dispensers are generally wall mounted and include a hinged cover which permits opening and closing of the dispenser housing so that the supply of fluid product may be refilled or replaced. Some fluid dispensers are manually actuated by pushing or pulling a handle, bar, or button on the dispenser. Others dispense automatically by sensing presence of a user or the user's hands near the dispenser.

SUMMARY

In general the disclosure is directed to fluid dispensers and fluid dispense mechanisms providing increased mechanical advantage as the dispense mechanism is moved throughout its range of motion.

In one example, the disclosure is directed to a dispenser comprising a housing, a reservoir positioned in the housing that contains a supply of a fluid to be dispensed, a dispense mechanism configured to dispense a discrete quantity of the fluid from the reservoir, the dispense mechanism comprising a lever member having a first lever section accessible on an exterior side of the housing, a second lever section, and a fulcrum connected between the first lever section and the second lever section, the fulcrum pivotally supported within the housing so that the lever member is moveable between a rest position and a dispense position upon application of an input force to the first lever section, and an actuator configured to provide at least two contact points with the second lever section as the lever member is moved from the rest position to the dispense position such that the mechanical advantage provided at a first one of the at least two contact points is greater than the mechanical advantage provided at a second one of the at least two contact points, such that an output force applied to the actuator at the first contact point is greater than an output force applied to the actuator at the second contact point.

In another example, the disclosure is directed to a dispenser comprising a housing, a reservoir positioned in the housing that contains a supply of a fluid to be dispensed, and a dispense mechanism configured to dispense a discrete quantity of the fluid from the reservoir, the dispense mechanism comprising a lever member having a first lever section accessible on an exterior side of the housing, a second lever section, and a fulcrum connected between the first lever section and the second lever section, the fulcrum pivotally supported within the housing such that the lever member is moveable between a rest position and a dispense position upon application of an input force to the first lever section, wherein movement of the lever member between the rest position and the dispense position results in application of an output force by the second lever section, and an actuator configured to receive application of the output force from the second lever section, a pump configured to receive the output force from the actuator and apply a corresponding dispensing force to the reservoir to dispense the discrete quantity of fluid from the reservoir, the second lever section configured to provide at least two contacts points with the actuator as the lever member is moved from the rest position to the dispense position such that the mechanical advantage provided at a first one of the at least two contact points is greater than the mechanical advantage provided at a second one of the at least two contact points, such that an output force applied to the actuator at the first contact point is greater than an output force applied to the actuator at the second contact point.

In another example, the disclosure is directed to A dispenser comprising a housing, a reservoir positioned in the housing that contains a supply of a fluid to be dispensed, a dispense mechanism configured to dispense a discrete quantity of the fluid from the reservoir, the dispense mechanism comprising a lever member having a first lever section accessible on an exterior side of the housing, a second lever section, and a fulcrum connected between the first lever section and the second lever section, the fulcrum pivotally supported within the housing such that the lever member is moveable between a rest position and a dispense position upon application of an input force to the first lever section, and such that movement of the lever member between the rest position and the dispense position results in application of a corresponding output force by the second lever section, and an actuator configured to receive application of the output force from the second lever section resulting in dispensation of the discrete quantity of the fluid from the reservoir, the lever member and the actuator operable to provide at least two contact surfaces between the actuator and the second lever section as the lever member is moved from the rest position to the dispense position such that the mechanical advantage provided at a first one of the at least two contact surfaces is greater than the mechanical advantage provided at a second one of the at least two contact surfaces, and such that the output force corresponding to the first contact surface is greater than the output force corresponding to the second contact surface.

The details of one or more examples are set forth in the accompanying drawings and the description below. Other features and advantages will be apparent from the description and drawings, and from the claims.

DETAILED DESCRIPTION

In general the disclosure is directed to fluid dispensers and fluid dispense mechanisms providing increased mechanical advantage as the dispense mechanism is moved throughout its range of motion. Dispensing of fluid products, such as liquids, gels, foams, etc., is becoming increasingly difficult due to the demand for fluid products having increased concentration, thickness, and quality. These product properties result in a product that is more difficult to dispense, and thus require more force to actuate the dispensing pump. However, dispenser manufacturers must at the same time comply with the Americans with Disabilities Act (ADA), which states that the force required to activate the controls of a hand soap dispenser in places of public accommodation or commercial facilities shall be no greater than 5 lbf (pounds of force).

Figure 1A:
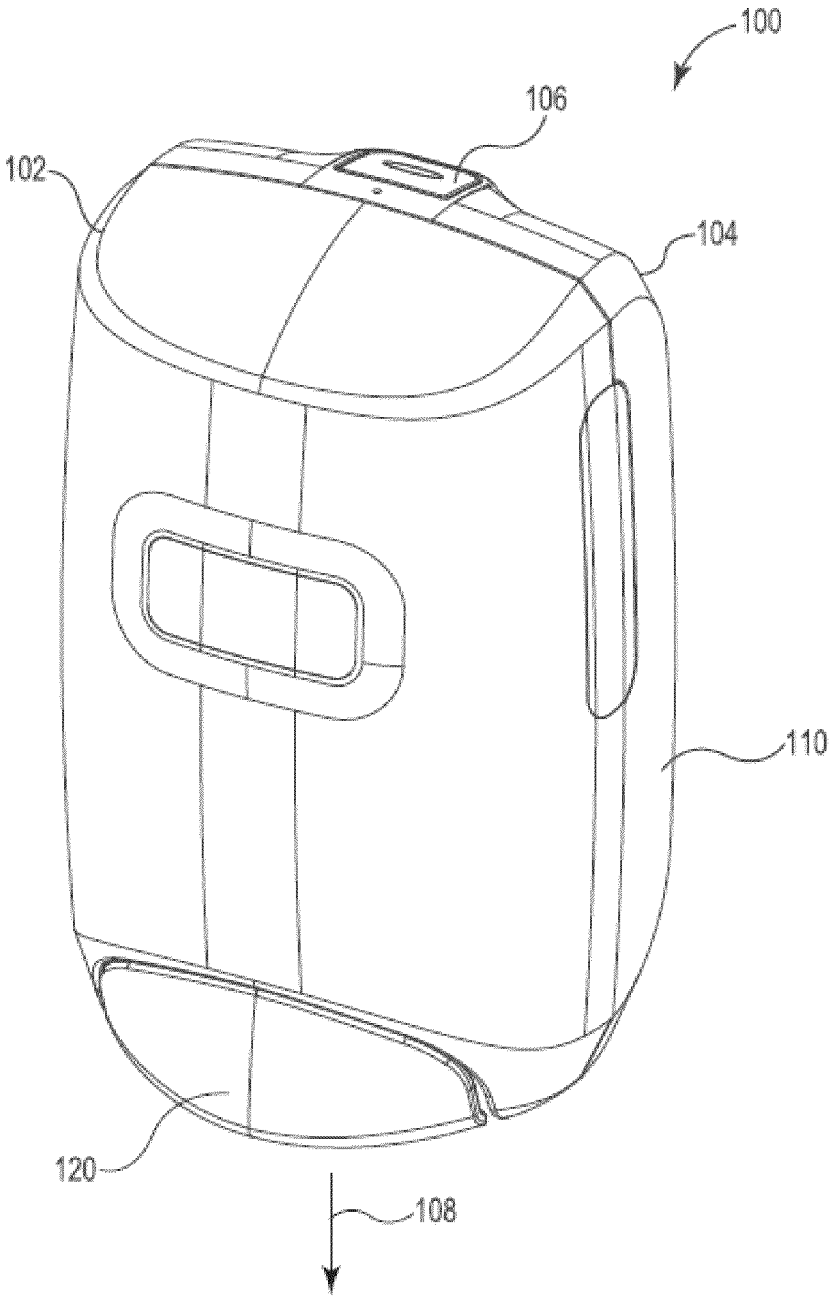
FIG. 1A is a perspective view of an example fluid dispenser that provides increased mechanical advantage.
Figure 1C:
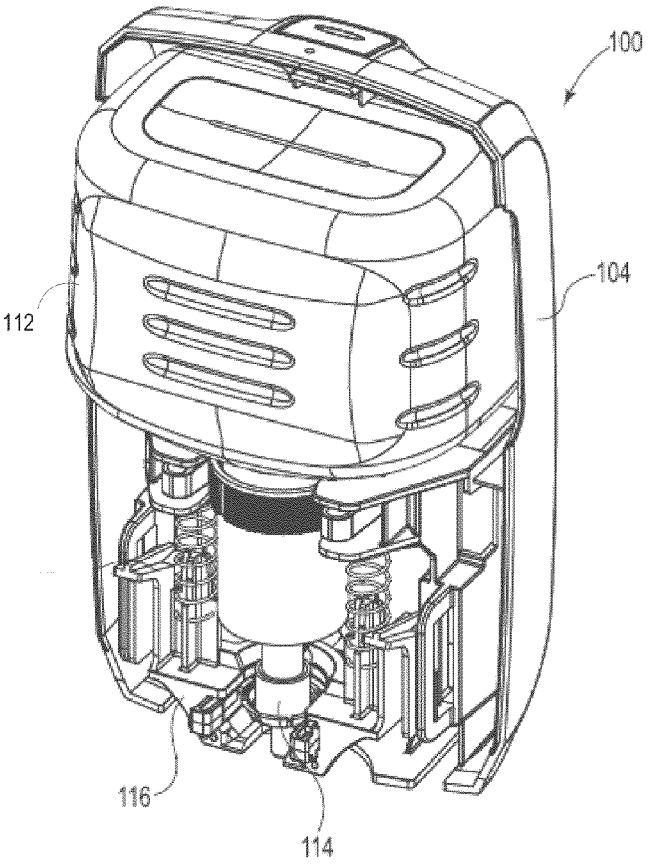
FIG. 1C is a front perspective view of the example fluid dispenser of FIGS. 1A and 1B) with the cover and the push bar removed.
Figure 1B:
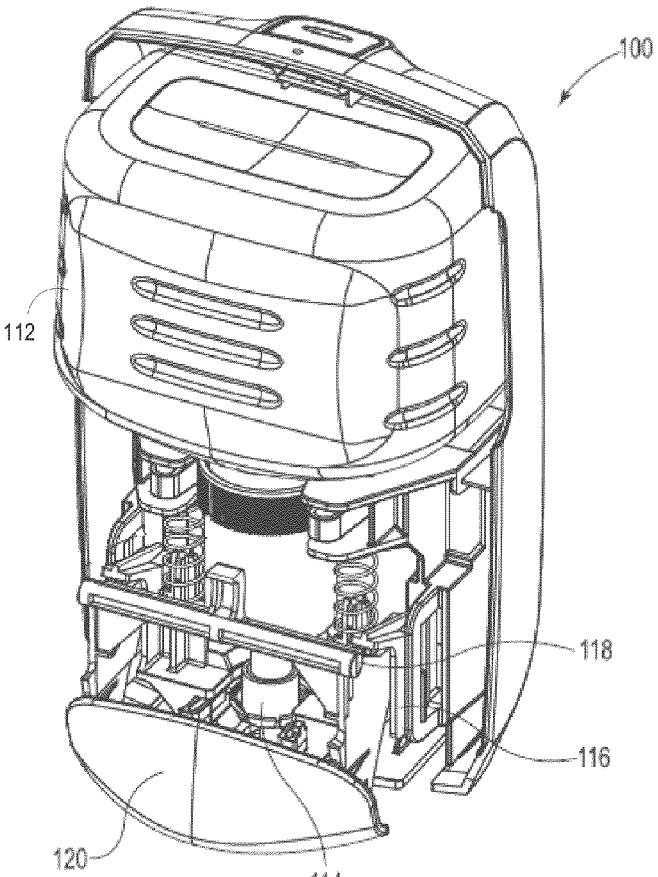
FIG. 1B is a front perspective view of the example fluid dispenser of FIG. 1A with the cover removed.

FIG. 1A is a front perspective view of an example fluid dispenser 100 that provides increased mechanical advantage in accordance with the present disclosure. FIG. 1B is a front perspective view of the example fluid dispenser 100 of FIG. 1A with the cover removed. FIG. 1C is a front perspective view of the example fluid dispenser 100 of FIGS. 1A and 1B) with both the cover and the push bar removed.

Example dispenser 100 includes a housing 110 having a front cover 102 and a back plate 104. A reservoir 112 (see FIGS. 1B and 1C) located within the interior of the housing 110 contains a supply of the fluid to be dispensed. Back plate 104 facilitates mounting of dispenser 100 to a wall or other object. In this example, housing 110 may include a hinge or hinges which permit cover 102 to pivot between a closed position and an open position. A button or latch 106 may be depressed to unlatch cover 102, thus permitting cover 102 to be opened and closed. A lever member 120, in this example a so-called push bar, manually operable by a user, is externally accessible on the outside of dispenser housing 110. Push bar 120 forms a part of a dispense mechanism, the other portions of which are physically located within the interior of housing 110 when the dispenser is fully assembled and the cover is closed, as shown in FIGS. 1B and 1C. Although for purposes of illustration the concepts of the present disclosure are generally described herein with reference to a push bar as the user actuatable lever member, it shall be understood that any other type of manually actuatable component, such as a push button, push or pull handle, or other type of lever configuration, may be substituted for the push bar, and that the disclosure is not limited in this respect.

As shown in FIGS. 1B and 1C, push bar 120 further includes a hinge 118. To incorporate push bar 120 into dispenser 100, hinge 118 may be pivotally mounted to the inside of the dispenser housing 110 or otherwise pivotally supported within the dispenser 100. Push bar 120, when depressed by a user, pivots around hinge 118 through a range of motion from a rest position to a dispense position. In this example, the rest position is the position of the push bar when no force is applied and the dispense position is the fully depressed position at which a metered dose of fluid is dispensed.

In addition to push bar 120, the dispense mechanism of dispenser 100 further includes an actuator 116. Application of an input force to push bar 120 results in a corresponding application of an output force to actuator 116. In response to application of the output force, actuator mechanically activates a pump 114 resulting in dispensation of the discrete quantity of the fluid 108 from reservoir 112.

Figure 2A:
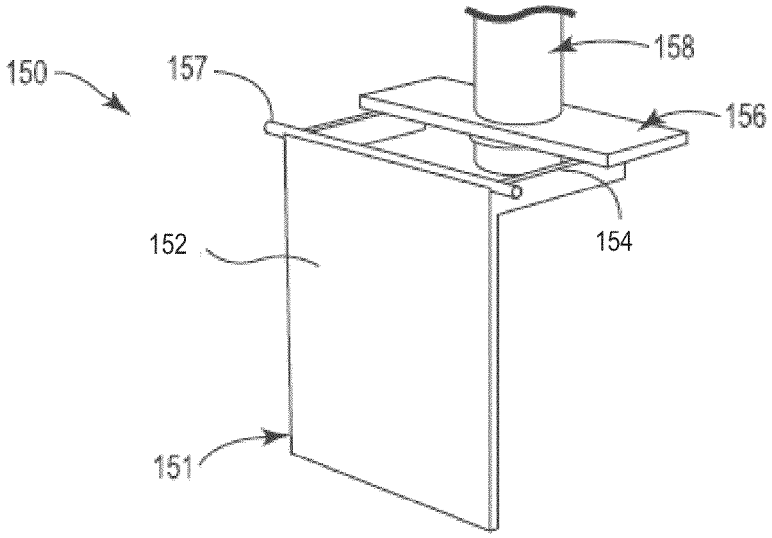
Fig. 2A (PRIOR ART)
FIGS. 2A and 2B are simplified perspective views of an example prior art dispense mechanism for a fluid dispenser.
Figure 2B:
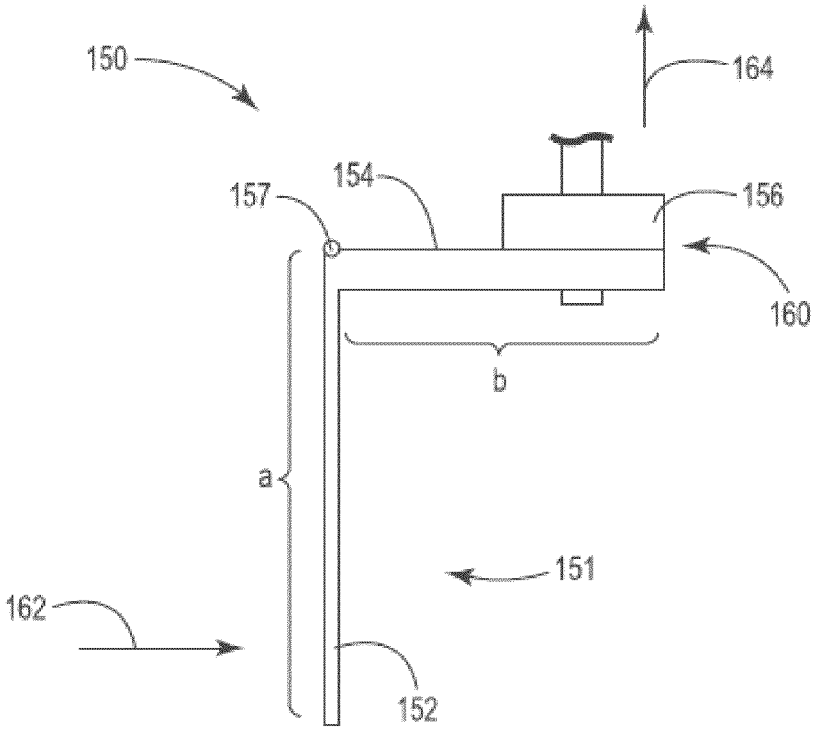
Fig. 2B (PRIOR ART)

FIGS. 2A and 2B are simplified views of an example prior art dispense mechanism 150 for a fluid dispenser. Housing 110, back plate 104, etc. are not shown for purposes of illustration. Dispense mechanism 150 includes a push bar 151, an actuator 156, and a pump 158. Push bar 151 generally operates in accordance with the principles of a lever. Push bar 151 includes a first lever section 152 and a second lever section 154 which pivot about an axis of rotation or fulcrum provided by a hinge or other pivot point 157. Hinge 157 may be substantially fixedly received into corresponding recesses or other attachment points located within the interior side of the dispenser housing. Application of an input force by a user to first lever section 152 in the direction indicated by arrow 162 causes push bar 151 to pivot on the axis provided by hinge 157. This results in a corresponding rotational movement of second lever section 154 and application of an output force to actuator 156, and thus to pump 158, in the direction of arrow 164. The output force applied to the lower surface of actuator 156 by the push bar in FIGS. 2A and 2B is focused at one contact point; namely, the distal end 160 of second lever section 154.

The ratio of the output force ($F_B$) to the input force ($F_A$), or mechanical advantage (MA), may be used as a measure of the force amplification of a lever. The concept of mechanical advantage may be applied to a push bar of a fluid dispenser, such as push bar 150 shown in FIGS. 2A and 2B. For example, the MA of push bar 151 may be expressed in terms of the input force, $F_A$, applied to the first lever section as indicated by arrow 162 and the output force, $F_B$, applied by the second lever section 154 to the actuator 156, as indicated by arrow 164. This ratio in turn is proportional to the ratio of the length, a, of the first lever section 152 and the length, b, of the second lever section 154 from a fulcrum or hinge 157:

$$MA = \frac{F_B}{F_A} = \frac{a}{b}.$$

In this example, the output force $F_B$ and thus the mechanical advantage provided by the push bar in FIGS. 2A and 2B is focused at one contact point; namely, the distal end 160 of second lever section 154. Thus, the length of the second lever section 154 for purposes of calculating the mechanical advantage in this example is equal to the total length b of the second lever section 154.

Figure 3C:
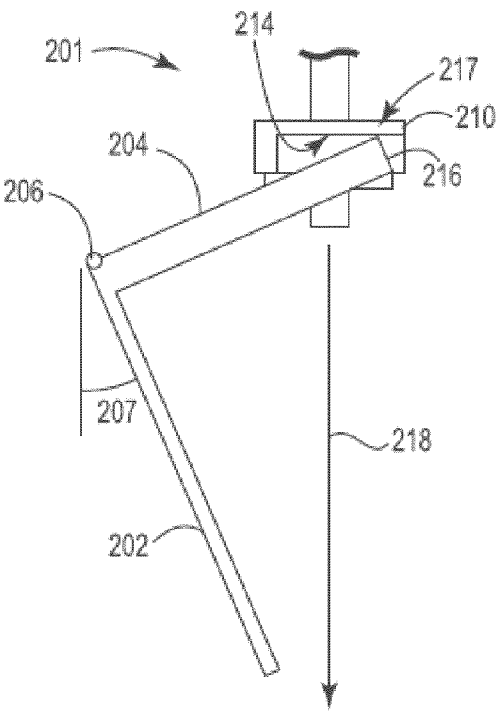
FIGS. 3A-3C show simplified side views of an example dispense mechanism in accordance with the present disclosure.
Figure 3B:
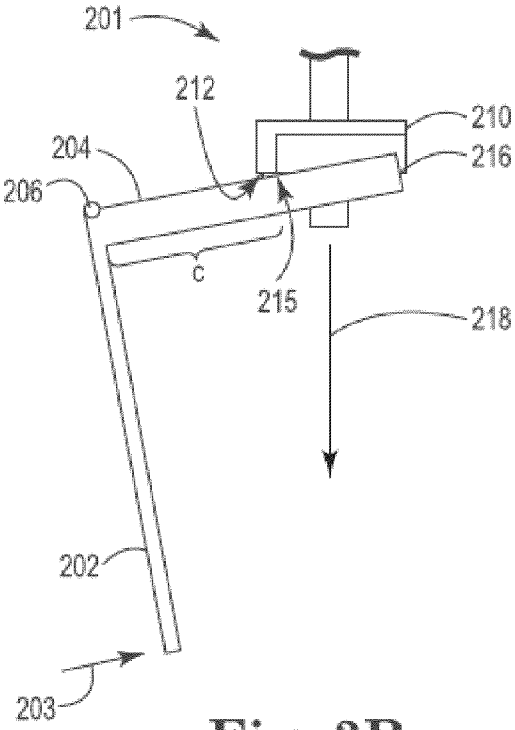
Figure 3A:
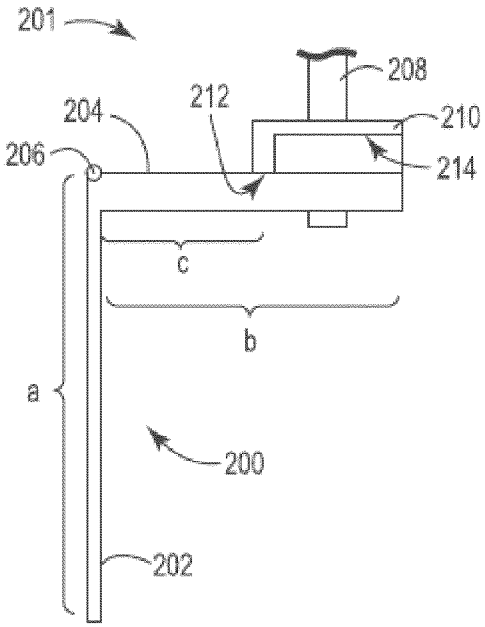

FIGS. 3A-3C show simplified side views of an example dispense mechanism 201 in accordance with the present disclosure. Dispense mechanism 201 includes a push bar 200, an actuator 210, and a pump 208. Push bar 200 includes a first lever section 202, a second lever section 204, and a hinge 206. First lever section 202 has a total length, a, and second lever section 204 has a total length, b. Actuator 210 is configured to allow for two points of contact with push bar 200. To that end, example actuator 210 includes a first contact surface 212 configured to contact second lever section 204 at a first contact point and a second contact surface 214 configured to contact second lever 204 section at a second contact point. The first contact point is indicated generally by reference numeral 215 and is located somewhere between the hinge 206 and the distal end 216 of second lever section 204. The second contact point is generally indicated by reference numeral 217 and is located at the distal end 216 of second lever section 204 in this example.

In operation, application of a force by a user to first lever section 202 in a direction generally indicated by arrow 203 causes push bar 200 to pivot on the axis provided by hinge 206. As shown in FIG. 3B, second lever section 204 first contacts and applies a force to first contact surface 212 at first contact point 215 located between hinge 206 and distal end 216 of second lever section 204. The distance between contact point 215 and hinge 206 is indicated by a length c. The drive length of the lever section to which the input force is applied at the beginning of dispenser operation is thus approximately equivalent to the distance c. It shall be understood that the distance c will vary somewhat as the push bar rotates about hinge 206; however, the drive length c will always be relatively shorter than the total length b of the section lever section 204 in this example.

Referring now to FIG. 3C, as push bar 200 continues to rotate about hinge 206, the second contact point 217 at distal end 216 of second lever section 204 contacts second contact surface 214 of actuator 210. The drive length of the lever section to which the input force is applied thus transitions from the relatively short drive length c to a relatively longer relative drive length given by b.

The mechanical advantage provided by the relatively shorter drive length, $MA_{short}$, in this example may be defined by:

$$MA_{short} = \frac{a}{c} = \frac{F_C}{F_A}$$

The mechanical advantage provided by the relatively longer drive length, $MA_{long}$, in this example may be defined by:

$$MA_{long} = \frac{a}{b} = \frac{F_B}{F_A}$$

Because push bar 200 first contacts actuator 210 with the short drive length, c, the mechanical advantage applied at the beginning of the dispenser operation is relatively higher than the mechanical advantage applied toward the end of the dispenser operation. This allows the pump to start dispensing with a relatively smaller amount of input force required from the user.

As push bar 200 rotates about hinge 206, actuator 210 is contacted by long drive length, b, and the MA is decreased as compared to the short drive length, c. In addition, the longer drive length defined by the length b reduces the angle, indicated by reference numeral 207, through which push bar 200 must travel to completely depress the pump. This may help to keep push bar 202 clear of the discharge spray 218, as shown in FIG. 3C. If only the short drive length c were used then the push bar may interfere with the pump spray, because the degree of rotation required to fully depress the push bar and to fully dispense the product may be increased.

Figure 4:
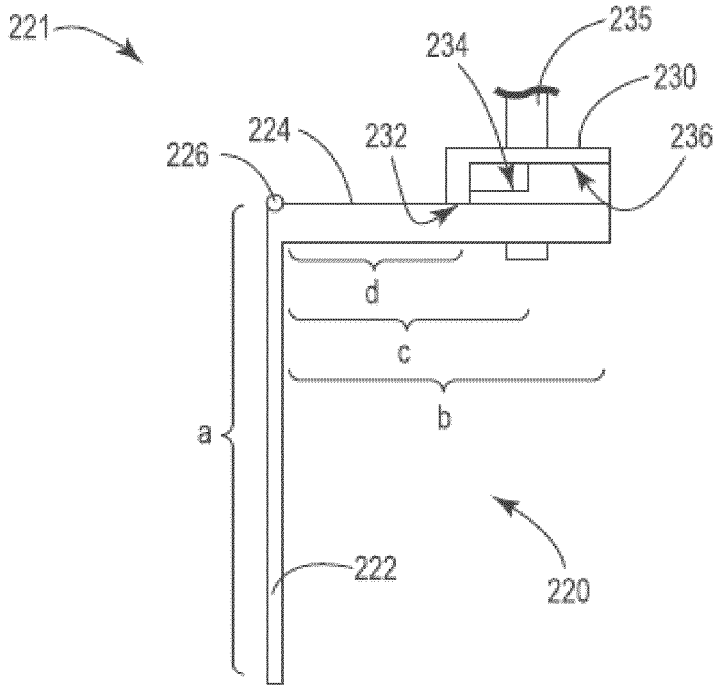
FIG. 4 shows a simplified side view of another example dispense mechanism in accordance with the present disclosure.

FIG. 4 shows a simplified side view of another example dispense mechanism 221 in accordance with the present disclosure. Dispense mechanism 221 includes a push bar 220, an actuator 230 and a pump 235 in accordance with the present disclosure. Push bar 220 includes a first lever section 222, a second lever section 224 and a hinge 226. First lever section 222 has a total length, a, and second lever section 224 has a total length, b. In this example, actuator 230 is configured to have three contact surfaces; a first contact surface 232, a second contact surface 234, and a third contact surface 236. In operation, second lever section 234 contacts first contact surface 222, second contact surface 224, and third contact surface 226 at drive lengths d, c, and b, respectively, throughout the rotation of push bar 220. Thus, as the push bar is moved through its range of motion, the mechanical advantage provided upon initial application of a dispensing force ($MA_d$ provided by drive length d at contact surface 232) is relatively larger than that provided during the middle of the stroke ($MA_c$ provided by drive length c at contact surface 234), which itself is relatively larger than that provided toward the end of the stroke ($MA_b$ provided by drive length b at contact surface 236). This relationship may be expressed by the following equation:

$$MA_d \geq MA_c \geq MA_b.$$

Figure 5A:
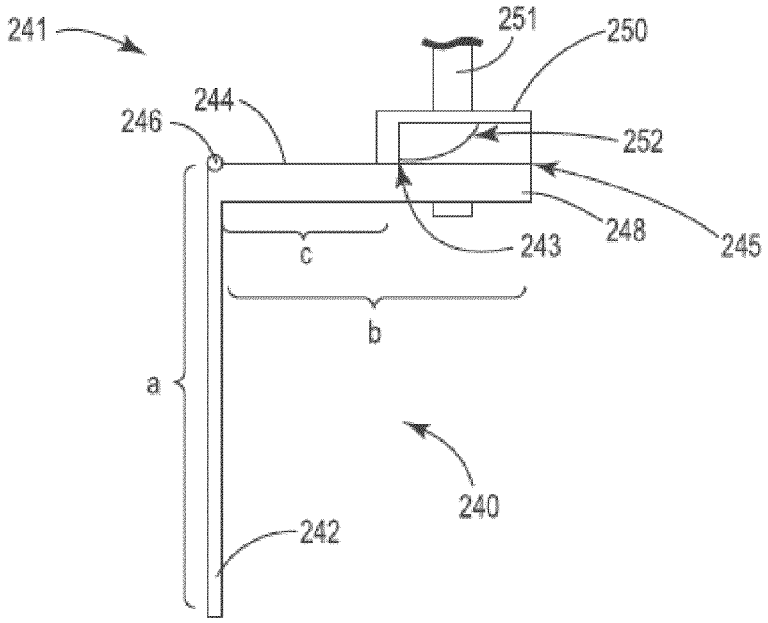
FIGS. 5A and 5B show simplified side views of another example dispense mechanism in accordance with the present disclosure.
Figure 5B:
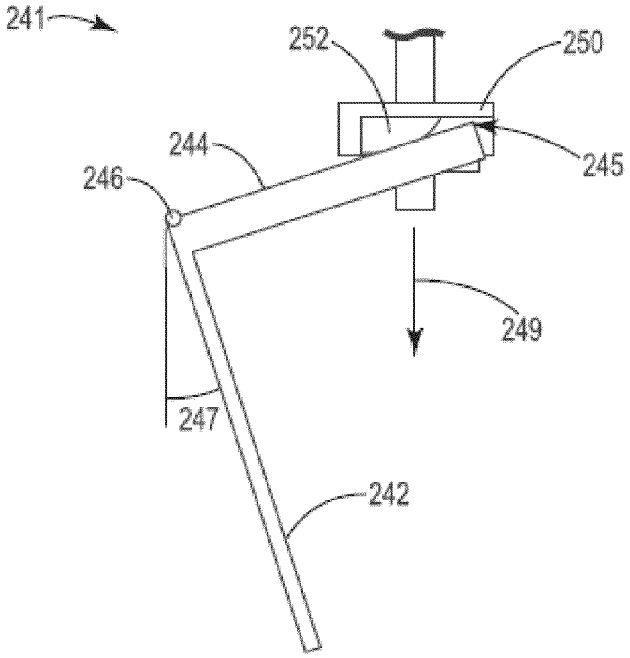

FIGS. 5A and 5B show simplified side views of another example dispense mechanism 241 in accordance with the present disclosure. Dispense mechanism 241 includes a push bar 240, an actuator 250 and a pump 251 in accordance with the present disclosure. Push bar 240 includes a first lever section 242, a second lever section 244 and a hinge 246. In this example, actuator 240 includes a curved contact surface 252. As push bar 240 rotates through its range of motion, surface 252 provides a continuously varying point of contact with the second lever section 244. The point of contact varies between a first contact point 243 at a drive length c located between hinge 246 and distal end 248 of second lever section 244 and a second contact point 245 at a drive length b located at the distal end of second lever section 244. Curved contact surface 252 may provide a smooth transition of contact along at least a portion of second lever section 244 of push bar 240, which may help provide a smoother user experience during operation of the dispenser. The angle of rotation 247 at full depression of push bar 240 is sufficiently small to avoid interference with fluid discharge stream 249.

Because push bar 240 first contacts actuator 250 with the short drive length, c, the mechanical advantage applied at the beginning of the dispenser operation is relatively higher than the mechanical advantage applied toward the end of the dispenser operation, when push bar 240 is contacting actuator 250 with the relatively longer drive length b.

Figure 6C:
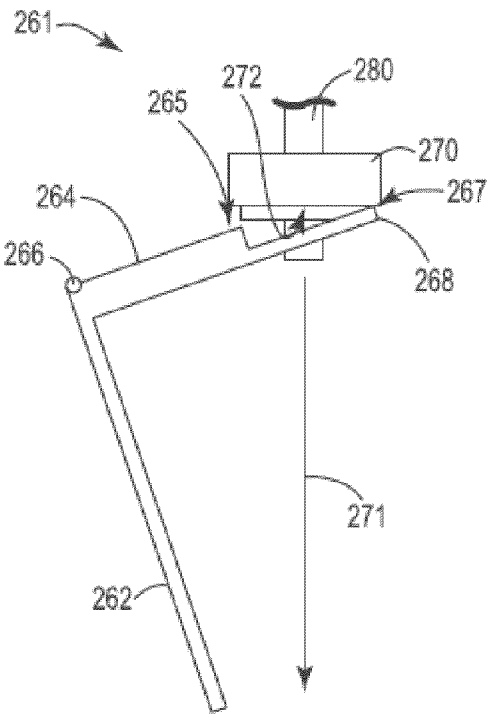
FIGS. 6A-6C show simplified side views of another example dispense mechanism in accordance with the present disclosure.
Figure 6B:
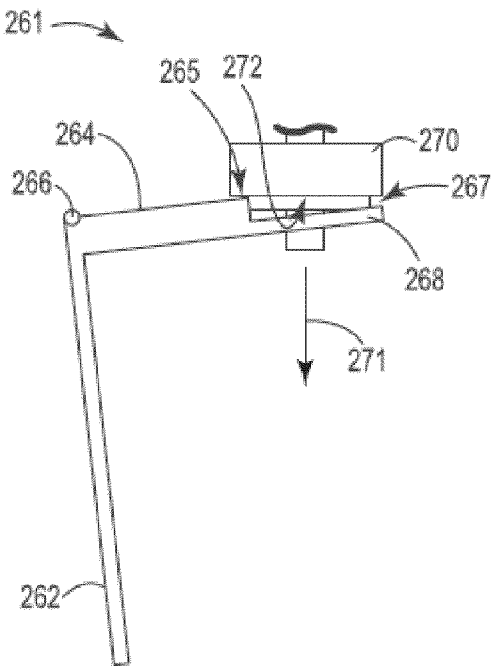
Figure 6A:
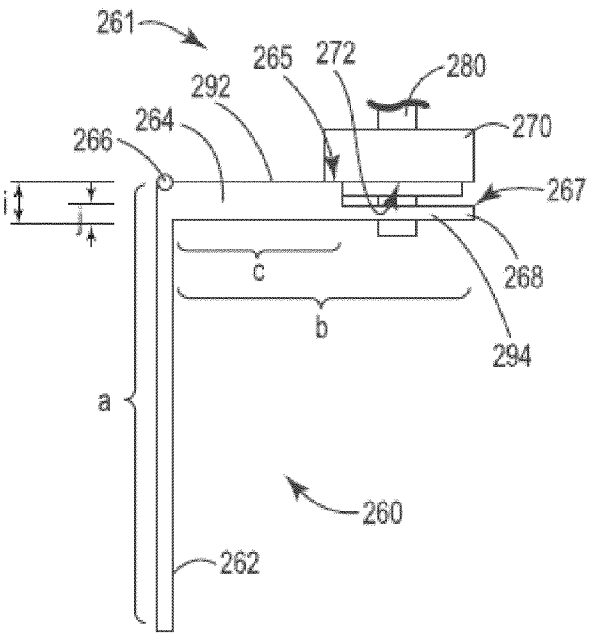

FIGS. 6A-6C show simplified side views of another example dispense mechanism 261 in accordance with the present disclosure. Dispense mechanism 261 includes a push bar 260, an actuator 270, and a pump 280 in accordance with the present disclosure. In this example, push bar 260 is configured to provide two points of contact with actuator 270. Push bar 260 includes a first lever section 262, a second lever section 264, and a hinge 266 connected between the first lever section 262 and the second lever section 264. Actuator 270 includes a contact surface 272. Second lever section 264 includes a base segment 292 connected to the hinge 266 and providing a first contact point 265 and a branch segment 294 connected distally adjacent to the base segment 292 and providing a second contact point 267. In this example, to provide for multiple contact points, base segment 292 and branch segment 294 are of differing thicknesses to provide first and second contact points 265 and 267, respectively. In this example, the thickness, i, of base segment 292 is relatively greater than the thickness, j, of branch segment 294.

In operation, second lever section 264 first applies an output force upon contact surface 272 at the relatively shorter drive length c. Then, as the rotation of push bar 260 continues, application of the force transitions to the relatively longer drive length b. Thus, as push bar 260 is moved through its range of motion, the mechanical advantage provided upon initial application of a dispensing force ($MA_c$ provided by drive length c by contact point 265) is relatively larger than the mechanical advantage provided during the latter portion of the stroke ($MA_b$ provided by drive length b by contact point 267). This relationship may be expressed by the following equation:

$$MA_c \geq MA_b.$$

Because push bar 260 first contacts actuator 270 with the short drive length, c, the mechanical advantage applied at the beginning of the dispenser operation is relatively higher than the mechanical advantage applied during the latter portion of the dispenser operation, when push bar 260 is contacting actuator 270 with the relatively longer drive length b.

Alternatively, push bar 260 may be configured to provide multiple points of contact. For example, second lever section 264 may include a base segment, such as base segment 292, connected to hinge 266 and providing a first contact point 265. Second lever section 264 may further include one or more branch segments connected distally adjacent to the base segment 261 and providing a corresponding one or more contact points. In this example, to provide for multiple contact points, the base segment and each of the one or more branch segments may have differing thicknesses to provide the multiple contact points. For example, each branch segment may have a relatively smaller thickness than the proximally adjacent branch segment.

Although specific example fluid dispensers are shown and described herein that provide for multiple points of contact during dispenser operation, it shall be understood that many other variations of the fluid dispensing mechanism may also be used without departing from the spirit and scope of the present disclosure. For example, the actuator and/or the push bar may be configured in a variety of different ways to provide for multiple points of contact during actuation of the dispenser. For example, an actuator may be configured to include any desired number of contact surfaces to provide multiple points of contact with a push bar, thus providing a corresponding number of different drive lengths throughout the range of motion of the push bar. In addition or in the alternative, a push bar may be configured to include any desired number of contact points to provide multiple points of contact with an actuator throughout its range of motion. As another example, both the actuator and the push bar may be configured to provide multiple points of contact corresponding to a different number of drive lengths through the range of motion of the push bar. It shall be understood, therefore, that the disclosure is not limited to the specific examples shown and described herein, that many other variations of actuator and/or push bar configurations may be used, and that the disclosure is not limited in this respect.

Various examples have been described. These and other examples are within the scope of the following claims.

The invention claimed is:

1. A dispenser comprising:

a housing;

a reservoir positioned in the housing that contains a supply of a fluid to be dispensed;

a dispense mechanism configured to dispense a discrete quantity of the fluid from the reservoir, the dispense mechanism comprising:

a lever member having a first lever section accessible on an exterior side of the housing, a second lever section, and a fulcrum connected between the first lever section and the second lever section, the fulcrum pivotally supported within the housing so that the lever member is moveable between a rest position and a dispense position upon application of an input force to the first lever section; and an actuator configured to provide two contact points with the second lever section as the lever member is moved from the rest position to the dispense position, the actuator comprising a first contact surface that contacts the second lever section at a first one of the two contact points and a second contact surface that contacts the second lever section at a second one of the two contact points, such that the mechanical advantage provided at the first contact point is greater than the mechanical advantage provide at the second contact point, such that an output force applied to the actuator at the first contact points is greater than an output force applied to the actuator at the second contact point.

2. The dispenser of claim 1 wherein the lever member comprises one of a push bar, a push button, or a handle.

3. The dispenser of claim 1 wherein the lever member is manually moveable by a user between the rest position and the dispense position.

4. The dispenser of claim 1 wherein a drive length of the first one of the at least two contact points is relatively shorter than a drive length provided by the second one of the at least two contact points.

5. The dispenser of claim 1 wherein the first lever section has a length (a), the second lever section has a length (b), the first contact point has a drive length (c) which is relatively less than the length (b) of the second lever section, and the mechanical advantage, $MA_{short}$, provided by the first contact point is:

$$MA_{short} = \frac{a}{c}.$$

6. The dispenser of claim 1 wherein the first lever section has a length (a), the second lever section has a length (b), the second contact point has a drive length substantially equal to the length (b) of the second lever section, and the mechanical advantage, $MA_{long}$, provided by the second contact point is:

$$MA_{long} = \frac{a}{b}.$$

7. The dispenser of claim 1 wherein the input force is no greater than 5 pounds of force (lbf).

8. The dispenser of claim 1 wherein the actuator further includes a first contact surface configured to receive application of an output force from the second lever section at the first contact point during a first portion of a dispensing stroke and a second contact surface configured to receive application of an output force from the second lever section at the second contact point during a second portion of a dispensing stroke.

9. The dispenser of claim 1 further including a pump, and wherein the actuator, in response to application of the output force, mechanically activates the pump resulting in dispensation of the discrete quantity of the fluid from the reservoir.

10. The dispenser of claim 1 wherein the fluid comprises one of a liquid, a gel, or a foam.

* * * * *